US009181058B2

(12) United States Patent
Ito

(10) Patent No.: US 9,181,058 B2
(45) Date of Patent: Nov. 10, 2015

(54) CORE TUBE HOLDING DEVICE AND RECORDING APPARATUS

(71) Applicant: SEIKO EPSON CORPORATION, Tokyo (JP)

(72) Inventor: Shun Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/484,143

(22) Filed: Sep. 11, 2014

(65) Prior Publication Data

US 2015/0091997 A1 Apr. 2, 2015

(30) Foreign Application Priority Data

Sep. 30, 2013 (JP) ..... 2013-203484

(51) Int. Cl.

| | |
|---|---|
| ***B41J 15/04*** | (2006.01) |
| ***B65H 16/06*** | (2006.01) |
| ***B41J 15/02*** | (2006.01) |
| ***B65H 75/08*** | (2006.01) |

(52) U.S. Cl.

CPC ..... *B65H 16/06* (2013.01); *B41J 15/02* (2013.01); *B65H 75/08* (2013.01)

(58) Field of Classification Search

CPC ..... B65H 16/06; B65H 75/08; B41J 15/02
USPC ..... 347/104
See application file for complete search history.

(56) References Cited

U.S. PATENT DOCUMENTS

| | | | | |
|---|---|---|---|---|
| 6,053,717 | A * | 4/2000 | Dixon | 418/122 |
| 6,315,235 | B1 * | 11/2001 | Breyer et al. | 242/422.4 |
| 2012/0032021 | A1 * | 2/2012 | Morinaga et al. | 242/577 |

FOREIGN PATENT DOCUMENTS

| | | |
|---|---|---|
| JP | 2012-066932 | 4/2012 |
| JP | 2013-047139 | 3/2013 |
| JP | 2003-171037 | 6/2013 |
| JP | 2013-147307 | 8/2013 |

* cited by examiner

*Primary Examiner* — Stephen Meier
*Assistant Examiner* — Alexander D Shenderov
(74) *Attorney, Agent, or Firm* — Workman Nydegger

(57) ABSTRACT

A core tube holding device includes: a holding portion which holds a cylindrical core tube extending in an axial direction; a support portion which supports the holding portion; a shaft portion which rotates the support portion and the holding portion; and a bearing portion which is connected to the support portion and into which the shaft portion is inserted. The holding portion and the bearing portion are formed to be harder than the support portion.

18 Claims, 11 Drawing Sheets

CORE TUBE HOLDING DEVICE AND RECORDING APPARATUS

BACKGROUND

1. Technical Field

The present invention relates to a core tube holding device which holds a recording medium wound around a cylindrical core tube extending in an axial direction, in a roll shape and a recording apparatus including the core tube holding device.

2. Related Art

Hitherto, a core tube holding device is used to hold a recording medium wound around a cylindrical core tube extending in an axial direction in a roll shape so as to be unwound in a transport direction or to hold the transported recording medium so as to be wound.

In a large-sized ink jet printer as disclosed in JP-A-2013-47139 and JP-A-2013-147307 described below, due to an increase in the weight of a recording medium wound in a roll shape, a higher degree of rigidity or durability is required of a core tube holding device which holds the recording medium.

In JP-A-2013-47139, a core tube holding device having a structure in which a first support portion that is provided on the inside and has a small diameter and a second support portion that is provided on the outside thereof and has a large diameter are coaxially arranged and are integrally formed of a synthetic resin in order to cope with a plurality of core tubes having different diameters is disclosed.

That is, the material of a holding portion which comes into contact with the core tube and directly holds the core tube, and the material of a bearing portion which is connected to the two support portions and into which a shaft portion that transmits a rotational force to the support portions is inserted are formed of the synthetic resin material.

In JP-A-2013-147307, a device in which a holding portion that directly holds a core tube and a support portion that supports the holding portion are separately provided and stainless steel is used as the material of the holding portion is exemplified.

In addition, a bearing portion into which the shaft portion is inserted is provided integrally with the support portion, and the material of the bearing portion is the same synthetic resin material as the support portion.

However, in JP-A-2013-47139, there is concern that due to a plurality of insertion and removal operations of the core tube with respect to the shaft portion and a load applied on the bearing portion caused by the rotation of the shaft portion, wear of the holding portion or damage of the bearing portion may occur.

In JP-A-2013-147307, a countermeasure against the wear of the holding portion is provided by using the stainless steel material that is significantly harder ("hard" is used as a concept including a meaning of high rigidity or high mechanical strength in the specification) than a synthetic resin, as the material of the holding portion. However, there is still a problem of concern for the damage of the bearing portion due to the load applied on the bearing portion caused by the rotation of the shaft portion.

SUMMARY

An advantage of some aspects of the invention is that it provides a core tube holding device which has both high durability and rigidity so as to bear an increase in the weight of a recording medium wound in a roll shape, and a recording apparatus including the core tube holding device. More specifically, a stable improvement in recording execution quality is achieved by suppressing wear and damage of a holding portion and a bearing portion of the core tube holding device and suppressing a reduction in transport accuracy of the recording apparatus.

A core tube holding device according to an aspect of the invention includes: a support portion which is able to support a core tube; a shaft portion which rotates the support portion; and a bearing portion which is connected to the support portion and into which the shaft portion is inserted, in which the bearing portion is harder than the support portion.

Here, comparison in hardness is performed by using a measurement method such as Vickers hardness (JIS2244) or Rockwell hardness (JIS K7202-2).

According to the aspect, the hardness of the bearing portion is increased to be greater than that of the support portion by forming the bearing portion of a harder material than that of the support portion or performing a surface treatment or the like thereon, thereby suppressing wear and damage of the bearing portion. In addition, durability and rigidity of the core tube holding device can be improved.

In the core tube holding device according to the aspect of the invention, a holding portion which holds the core tube may further be included, and the support portion may be able to support the core tube via the holding portion.

According to the aspect, since the holding portion that holds the core tube is provided, the hardness of the holding portion is increased to be greater than that of the support portion by forming the holding portion of a harder material than that of the support portion or performing a surface treatment or the like thereon, thereby suppressing wear and damage of the holding portion. In addition, durability and rigidity of the core tube holding device can be improved.

In the core tube holding device according to the aspect of the invention, the shaft portion may be harder than the support portion.

According to the aspect, since the hardness of the shaft portion is greater than that of the support portion, a large rotational force can be transmitted to the support portion due to the hardness of the bearing portion. In addition, wear and damage of the shaft portion can be reduced when the rotational force is transmitted, and thus the stable rotation transmission from the shaft portion is possible.

In the core tube holding device according to the aspect of the invention, hardnesses of the holding portion, the shaft portion, and the bearing portion may be the same.

Here, "be the same" does not necessarily mean "be strictly the same" and is used as a meaning that "be the same" can be mentioned as long as the obtained effects are substantially the same.

According to the aspect, the same hardness can be imparted by forming the holding portion, the shaft portion, and the bearing portion of the same material or performing the same surface treatment or the like. Therefore, the manufacturing cost of the core tube holding device can be reduced by reducing component costs. In addition, since the hardnesses of the shaft portion and the bearing portion which are directly fitted to each other are the same, the shaft portion and the bearing portion are worn at the same degree, and thus one-sided wear in which only one of the shaft portion and the bearing portion is worn first is suppressed.

In the core tube holding device according to the aspect of the invention, the support portion may include a first opening into which the shaft portion is inserted, the bearing portion may include a second opening into which the shaft portion is inserted, and the first opening and the second opening may be different in at least one of size and shape.

According to the aspect, a portion of the shaft portion is inserted into the first opening formed in the support portion so as to be supported, and the other portion of the shaft portion is inserted into the second opening formed in the bearing portion provided separately from the support portion so as to be supported. Accordingly, the first opening and the second opening are caused to be different in any one of or both size and shape. In addition, by causing the shapes and sizes of the openings to be different, the directions of the first opening and the second opening contacting the shaft portion are different. As a result, fitting and fixing of the support portion and the bearing portion to the shaft portion can be stably performed.

In the core tube holding device according to the aspect of the invention, the first opening of the support portion may include a first contact portion which comes into contact with the shaft portion and guides relative movement of the support portion when the support portion is moved relative to the shaft portion in an axial direction, and the second opening of the bearing portion may include a second contact portion which is pressed against and comes into contact with the shaft portion when the bearing portion and the shaft portion are fixed to each other.

According to the aspect, in the first opening of the support portion, the first contact portion formed in the first opening has a guiding action during the insertion of the shaft portion, and in the second opening of the bearing portion, the second contact portion formed in the second opening provided separately from the first opening has a pressing and fixing action after the insertion of the shaft portion. Therefore, the shaft portion is easily inserted into the support portion and the bearing portion by reducing a guide length with respect to the shaft portion, and a stable and reliable fitting and fixing state of the bearing portion and the shaft portion is ensured by the pressing and fixing action of the shaft portion by the second contact portion.

In the core tube holding device according to the aspect of the invention, the first opening and the second opening may be elliptical openings in which two opposing surfaces are formed as arc surfaces having the same radius and the other two opposing surfaces are formed as flat surfaces that are parallel to each other, the opposing arc surfaces of the first opening may form the first contact portion which comes into contact with the shaft portion, and the two opposing flat surfaces of the second opening may form the second contact portion which is pressed against and comes into contact with the shaft portion.

According to the aspect, since the first opening and the second opening are the elliptical openings, the guide action of the shaft portion having the same shape inserted into the first opening and the second opening can be performed in a state where the relative rotation of the two is suppressed. In addition, since a contact action surface by the first contact portion and a contact action surface by the second contact portion act on the shaft portion in directions perpendicular to each other at a phase difference of 90 degrees, eccentricity of the first opening and the second opening with respect to the shaft portion is suppressed, and thus the rotation of the shaft portion can be efficiently transmitted to the support portion and the bearing portion.

In the core tube holding device according to the aspect of the invention, the holding portion may include a first holding portion which is able to hold the core tube having a first size and a second holding portion which is able to hold the core tube having a second size smaller than the first size.

According to the aspect, since a plurality of core tubes having different sizes can be separately held in the first holding portion and the second holding portion, the action length of the holding portion can be set to be short compared to a case where a single holding portion holds the plurality of core tubes having different sizes, and thus a core tube holding device which is compact and in which the core tube is easily mounted can be provided.

In the core tube holding device according to the aspect of the invention, the support portion may include a first support portion which supports the first holding portion and a second support portion which supports the second holding portion, and the second support portion may be disposed on an outside of the first support portion in an axial direction of the held core tube.

According to the aspect, the action length of the support portion can be set to be short as in the holding portion, and thus the core tube holding device which is compact and in which the core tube is easily mounted can be provided. In addition, since the second support portion which supports the second holding portion that holds the small core tube having the second size is disposed on the outside, that is, the tip end side of the first support portion which supports the first holding portion that holds the large core tube having the first size, the plurality of core tubes having different sizes can be smoothly mounted in the same mounting order.

In the core tube holding device according to the aspect of the invention, the first support portion may include a first recessed portion for mounting the first holding portion, and a depth of a recessed portion which is formed in a joint side end surface joined to the second support portion in the first recessed portion may be set to be a depth at which the first holding portion does not protrude from the joint side end surface of the first support portion toward the second support portion side in a state where the first holding portion is supported by the first support portion.

According to the aspect, in a joint state in which the base end side end surface of the second support portion abuts on the joint side end surface of the first support portion, there is no concern of the tip end portion of the first holding portion protruding from the joint side end surface of the first support portion and abutting on the second support portion or the second holding portion. Therefore, the movement of the first holding portion and the second holding portion in the radial direction and in the axial direction becomes smooth, and variations in the size of the core tube are absorbed, thereby reliably holding the core tube.

In the core tube holding device according to the aspect of the invention, a distance between the second contact portion which is formed in the second opening of the bearing portion and the other second contact portion opposing thereto may be adjustable.

According to the aspect, by adjusting the distance between the opposing second contact portions depending on variations in the dimensions of the fixing portion of the shaft portion, variations in the dimensions of the fixing portion of the shaft portion can be absorbed. Therefore, the shaft portion can always be stably and reliably fixed.

A recording apparatus according to another aspect of the invention includes: a recording execution device which executes recording on a recording medium; and a core tube holding device which holds a cylindrical core tube that is able to hold the recording medium in a roll shape, in which the core tube holding device is the core tube holding device according to the above aspect.

According to the aspect, in a large-sized ink jet printer in which the weight of the recording medium wound in a roll shape is increased, wear and damage of the holding portion and the bearing portion of the core tube holding device, which particularly cause problems, can be effectively suppressed, and thus a reduction in transport accuracy of the recording apparatus is suppressed, thereby achieving a stable improvement in recording execution quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment (see FIGS. 1 to 11)

Figure 1:
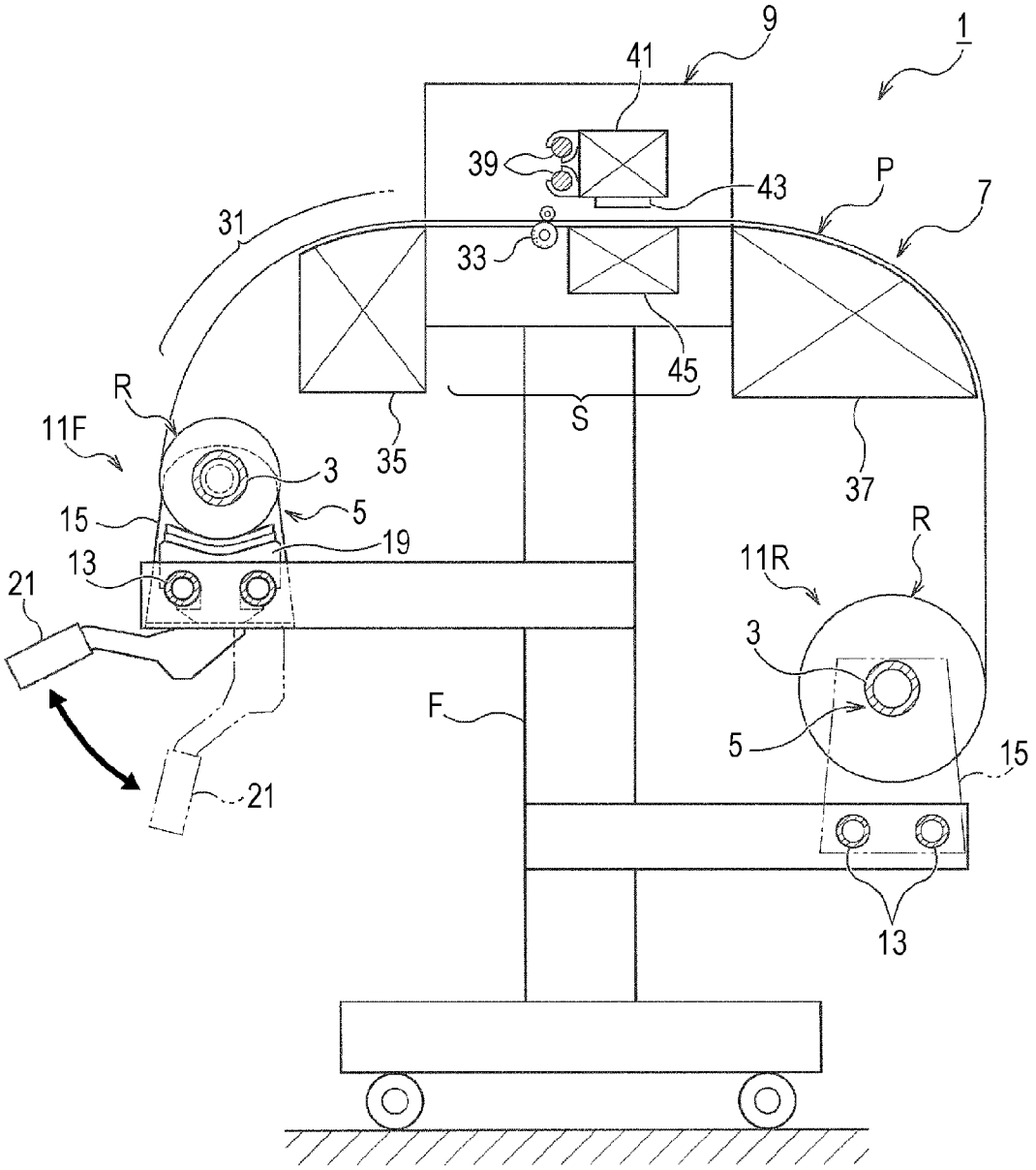
FIG. 1 is a side cross-sectional view illustrating a recording apparatus to which a core tube holding device according to an embodiment of the invention is applied.

Hereinafter, a core tube holding device according to an embodiment of the invention and a recording apparatus provided with the core tube holding device will be described in detail with reference to the accompanying drawings.

First, (1) the schematic configuration of the recording apparatus provided with the core tube holding device according to this embodiment will be described, and (2) the specific structure of the core tube holding device and (3) the action of the core tube holding device according to this embodiment will be sequentially described.

1. Schematic Configuration of Recording Apparatus (See FIGS. 1 to 3)

A recording apparatus 1 according to the embodiment of the invention includes a core tube holding device 5 which holds a recording medium (hereinafter, also referred to as "a roll medium") R that is wound in a roll shape around a cylindrical core tube 3 extending in the axial direction (in FIG. 2, the right and left direction), a recording execution device 9 which executes a predetermined recording operation by discharging ink to a recording medium P supplied to a recording execution area S, and a medium transporting device 7 which transports the recording medium P, which is unwound from the roll medium R held by the core tube holding device 5, to the recording execution area S and transports the recording medium P, on which recording is executed in the recording execution area S, to the outside of the recording execution area S.

Figure 2:
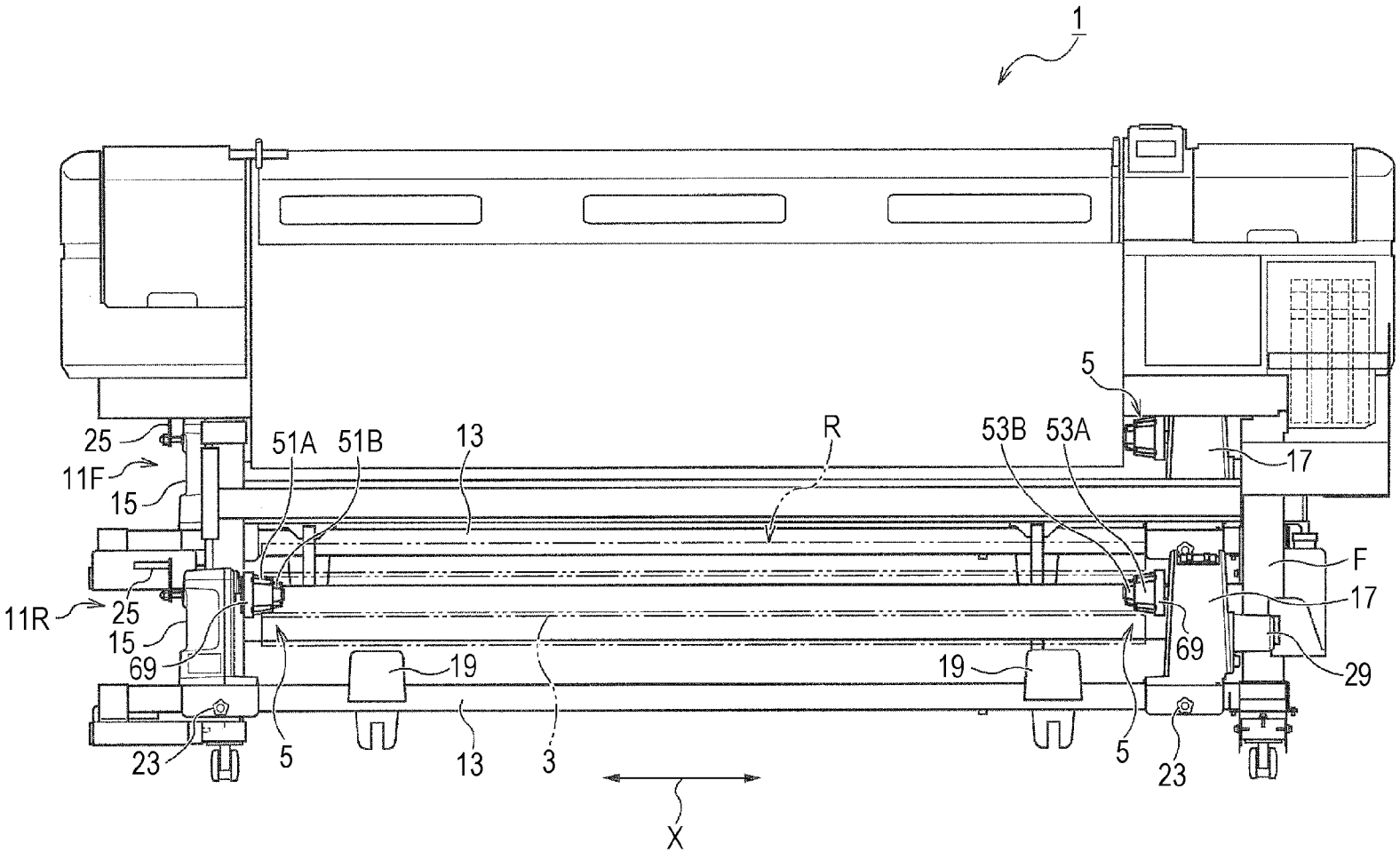
FIG. 2 is a front view illustrating the recording apparatus to which the core tube holding device according to the embodiment of the invention is applied.

In this embodiment, as illustrated in FIGS. 1 and 2, a large-sized ink jet printer is illustrated as an example of the recording apparatus 1. In the recording apparatus 1 in FIG. 2, the heavy roll medium R having a width of B0 extended size or A0 extended size that is wide in the right and left direction X is set.

In this specification, a case of mentioning the roll medium R means a state where the sheet-like recording medium P is wound in a roll shape around the core tube 3, and a case of simply mentioning the recording medium P means a state of being unwound from the roll medium R and deployed in a sheet shape.

The recording apparatus 1 is supported by a dedicated stand F illustrated in the figure as a support frame, and an unwinding core tube holding unit 11F and a winding core tube holding unit 11R are respectively disposed on the rear side and the front side of the dedicated stand F as an example.

In addition, a core tube holding device 5 is disposed on each of the right and left sides of the unwinding core tube holding unit 11F and the winding core tube holding unit 11R, that is, a total of four core tube holding devices 5 are arranged so that the tip end portion thereof faces the inside.

Figure 3:
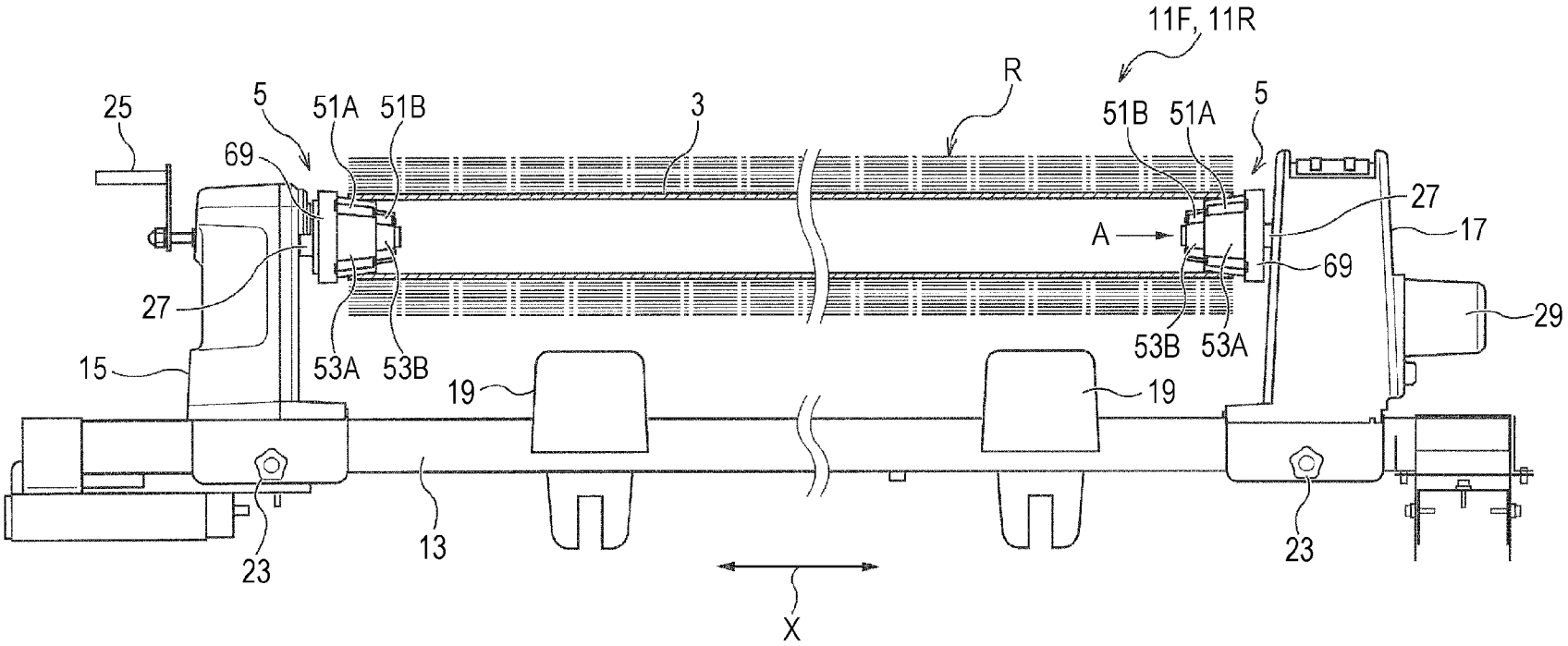
FIG. 3 is a front view illustrating a state where the core tube holding device according to the embodiment of the invention is disposed on a support rod.

The unwinding core tube holding unit 11F and the winding core tube holding unit 11R have the same configuration. FIG. 3 illustrates the winding core tube holding unit 11R as an example. As illustrated in FIG. 3, two support rods 13 which extend in the right and left direction X are supported by the dedicated stand F. An adjustment holder 15 which supports the free end surface of the core tube 3 and a reference holder 17 which supports the base end surface of the core tube 3 are respectively disposed on the left end side and the right end side of the support rod 13 to be slidable in the axial direction X.

As illustrated in FIG. 1, temporary placing tables 19 having recessed surfaces on the upper surfaces are disposed on the support rod 13 on the insides of the adjustment holder 15 and the reference holder 17 of the unwinding core tube holding unit 11F. An operating lever 21 for moving the roll medium R placed on the temporary placing table 19 to the axial cores of the adjustment holder 15 and the reference holder 17 with a small amount of force without being raised by hand is provided in the vicinity of the temporary placing table 19.

Adjustment screws 23 with manual knobs are attached to the lower end portions of the adjustment holder 15 and the reference holder 17, and are configured so that the positions of the adjustment holder 15 and the reference holder 17 can be fixed by fastening the adjustment screws 23 and the positions of the adjustment holder 15 and the reference holder 17 can be moved in the axial direction X and can be adjusted by loosening the adjustment screws 23.

A manual type operating handle 25 is provided in the upper portion of the adjustment holder 15 provided on the left end side of the support rod 13, and has a function of increasing a holding force when a shaft portion 27 of the core tube holding device 5 moves a predetermined stroke in the axial direction X to hold the core tube 3 and a function of releasing the holding force and facilitating the removal of the core tube 3 during the removal, by rotating the operating handle 25.

A motor 29 which rotates the shaft portion 27 is attached to the end surface of the outside of the reference holder 17 provided on the right end side of the support rod 13. In addition, the motor 29 is configured so that the rotation of the output shaft thereof is transmitted to the shaft portion 27 via a drive transmission mechanism (not illustrated).

Accordingly, the core tube holding device 5 supported by the reference holder 17 functions as a drive portion which is rotated along the rotation of the motor 29, and the core tube holding device 5 supported by the adjustment holder 15 functions as a driven portion which is rotated by the rotation transmitted via the core tube 3.

The unwinding core tube holding unit 11F and the winding core tube holding unit 11R described above form a part of the medium transporting device 7. In addition, the medium transporting device 7 is configured to further include a transport path 31, a pinch roller 33 provided in the middle of the transport path 31, and the like. The transport path 31 is formed to guide the recording medium P unwound from the unwinding core tube holding unit 11F in the upward direction, draw the recording medium P in the forward direction through the recording execution area S provided at the top position as an example of the recording apparatus 1, and thereafter guide the recording medium P in the downward direction to the winding core tube holding unit 11R provided on the front side of the dedicated stand F.

A member denoted by reference numeral 35 in FIG. 1 is a preheater which dries the recording medium P before executing recording, and a member denoted by reference numeral 37 in FIG. 1 is an after-heater which dries ink discharged on the recording surface of the recording medium P after executing the recording.

The recording execution device 9 includes a carriage 41 which reciprocates in the right and left direction along a carriage guide shaft 39, a recording head 43 which executes recording by discharging ink to the recording medium P attached to the lower surface of the carriage 41, and a platen 45 which supports the recording medium P and adjusts the gap between the recording head 43 and the recording medium P. The recording head may be a single or a plurality of recording heads (line heads) which realize a nozzle row having a length corresponding to the length of the recording medium in the direction perpendicular to the transporting direction.

The pinch roller 33 which is a constituent member of the medium transporting device 7 described above is provided at a positions upstream of the recording head 43 and the platen 45. The pinch roller 33 functions as a feed roller which feeds the recording medium P sent to the recording execution area S to the lower side of the recording head 43.

2. Specific Structure of Core Tube Holding Device (See FIGS. 4 to 11)

Figure 4:
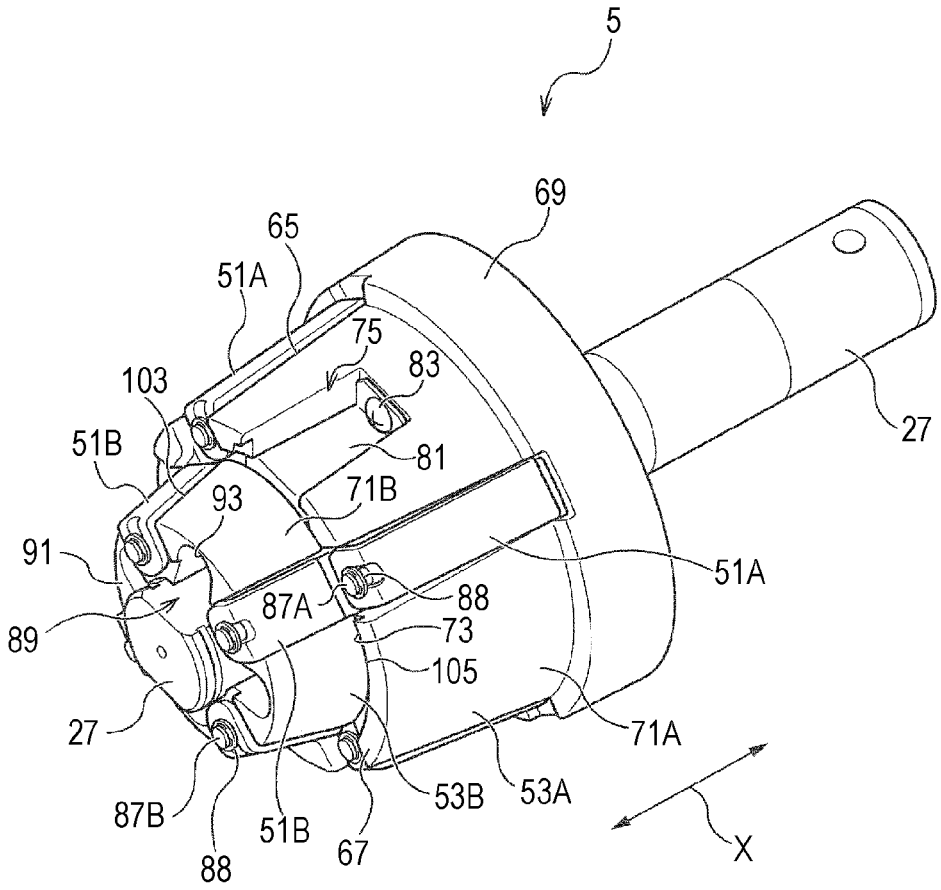
FIG. 4 is a perspective view illustrating a state where the core tube holding device according to the embodiment of the invention is assembled.
Figure 5:
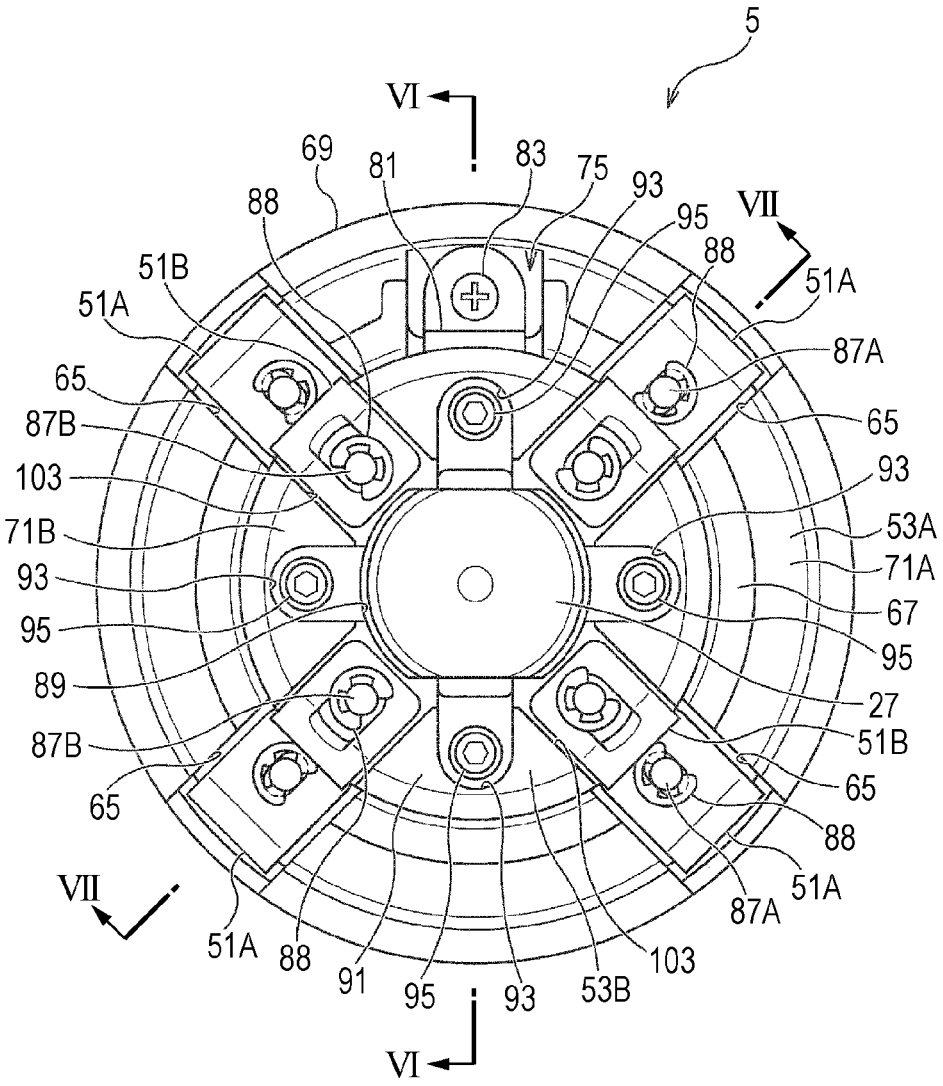
FIG. 5 is a view illustrating the core tube holding device according to the embodiment of the invention when viewed from the arrow A of FIG. 3.

As illustrated in FIGS. 4 and 5, the core tube holding device 5 according to the embodiment of the invention is basically configured by including a holding portion 51 (which will be denoted by 51A and 51B by attaching A and B thereto in a case of distinguishing a plurality of members from each other, and hereinafter, the same applies to other constituent members) which holds the cylindrical core tube 3 extending in the axial direction X, a support portion 53 which supports the holding portion 51, the shaft portion 27 which causes the support portion 53 and the holding portion 51 to rotate, and a bearing portion 55 which is connected to the support portion 53 and into which the shaft portion 27 is inserted.

The holding portion 51 and the bearing portion 55 are formed to be harder than the support portion 53. Furthermore, in this embodiment, the shaft portion 27 is formed to be harder than the support portion 53. Moreover, in this embodiment, the hardnesses of the holding portion 51, the shaft portion 27, and the bearing portion 55 are set to be the same.

The "hardness" mentioned here means a "Vickers hardness" specified in JIS2244 or a "Rockwell hardness" specified in JIS K7202-2 as an example, and in the specification, is used as a broader concept that includes a meaning of high rigidity or high mechanical strength as described above. In addition, in order to impart hardness, for example, a hard material is used or a surface treatment or the like is performed to make a material hard.

In this embodiment, the hardness having the above-described meaning is imparted by forming the shaft portion 27, the holding portion 51, and the bearing portion 55 of a metal material, and a reduction in the overall weight of the device is achieved by forming the support portion 53 having a large volume of a synthetic resin material.

Figure 6:
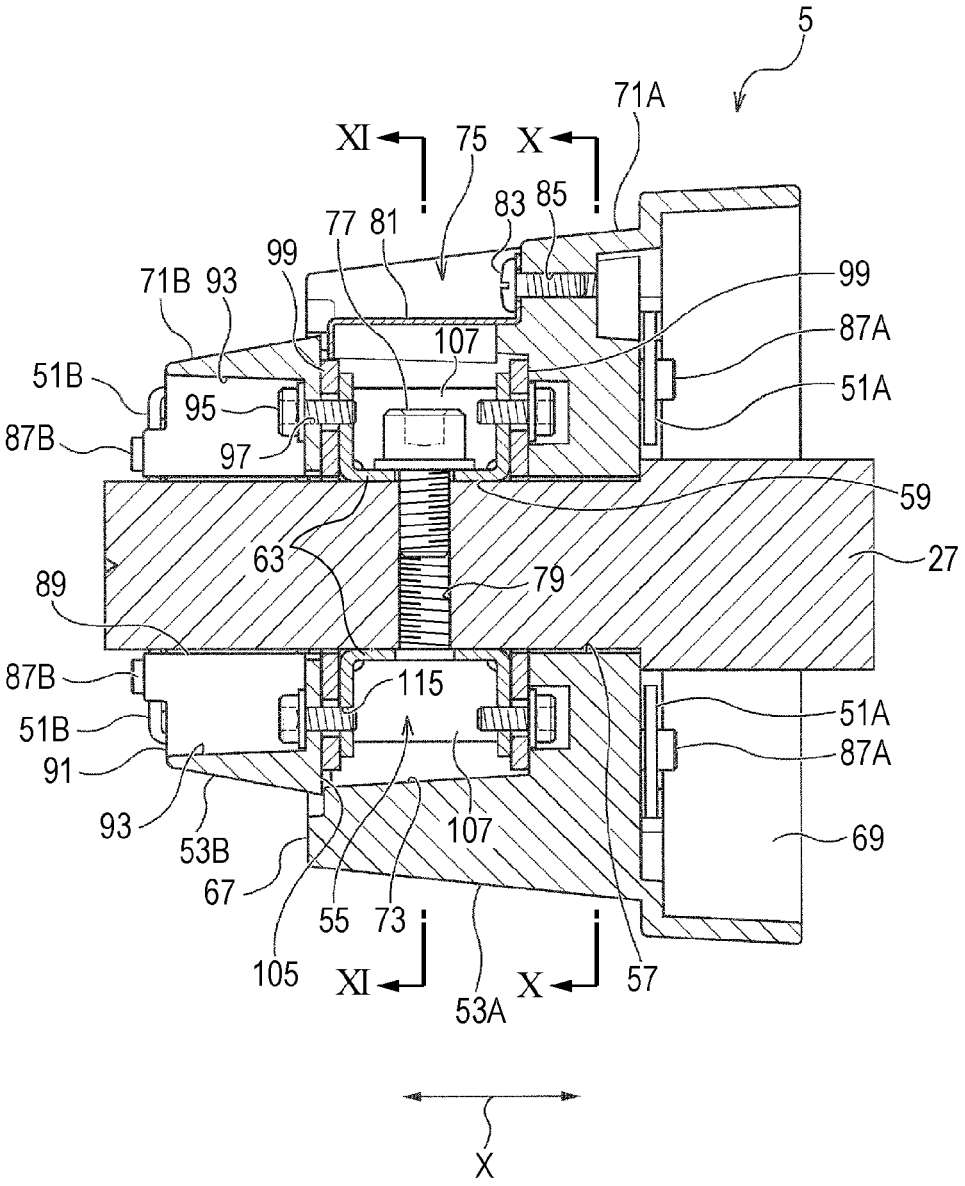
FIG. 6 is a cross-sectional view illustrating the core tube holding device according to the embodiment of the invention taken along line VI-VI of FIG. 5.
Figure 7:
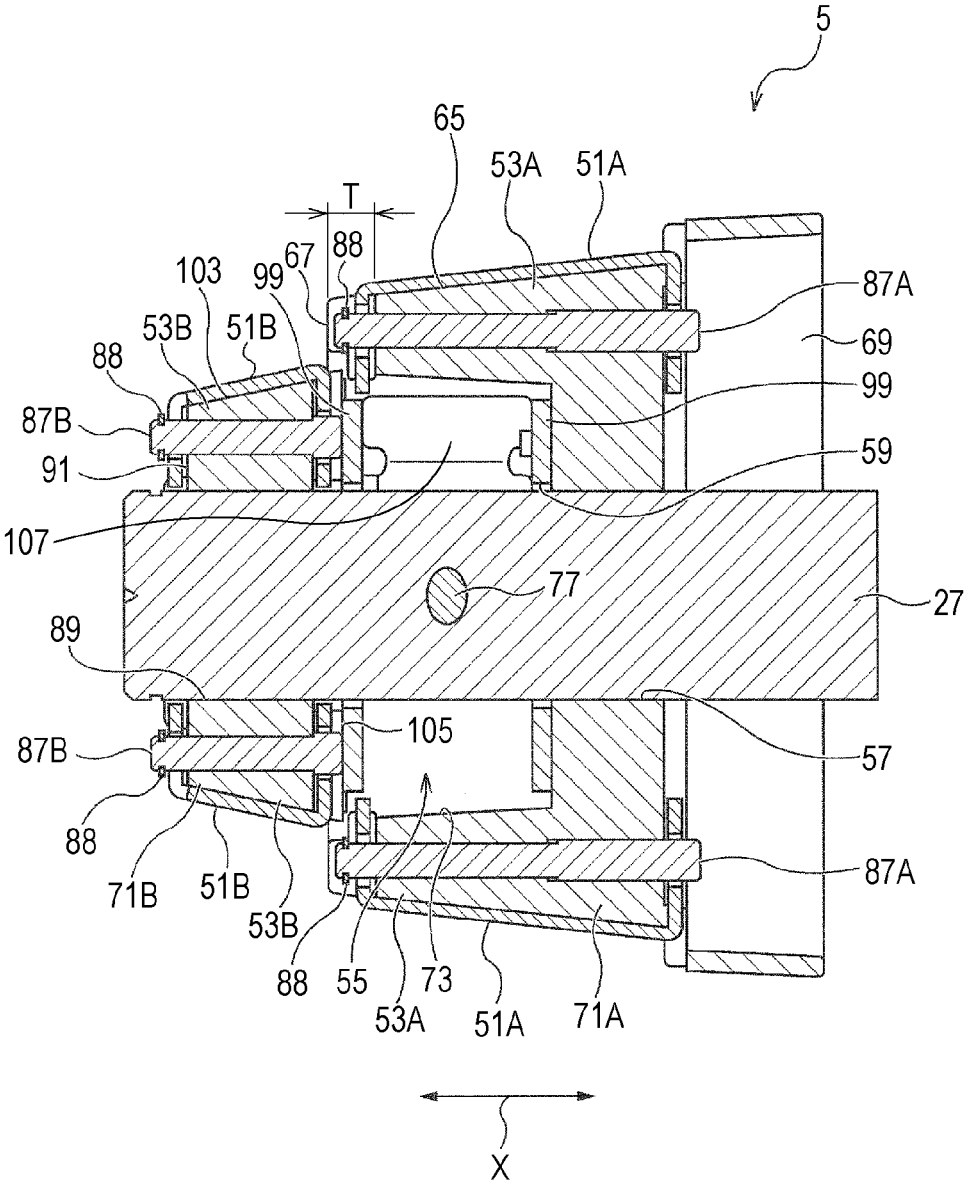
FIG. 7 is a cross-sectional view illustrating the core tube holding device according to the embodiment of the invention taken along line VII-VII of FIG. 5.

In addition, as illustrated in FIGS. 6 and 7, the support portion 53 includes a first opening 57 into which the shaft portion 27 is inserted, and the bearing portion 55 includes a second opening 59 into which the shaft portion 27 is inserted. The first opening 57 and the second opening 59 are formed to be different in both or any one of size and shape.

Figure 8:
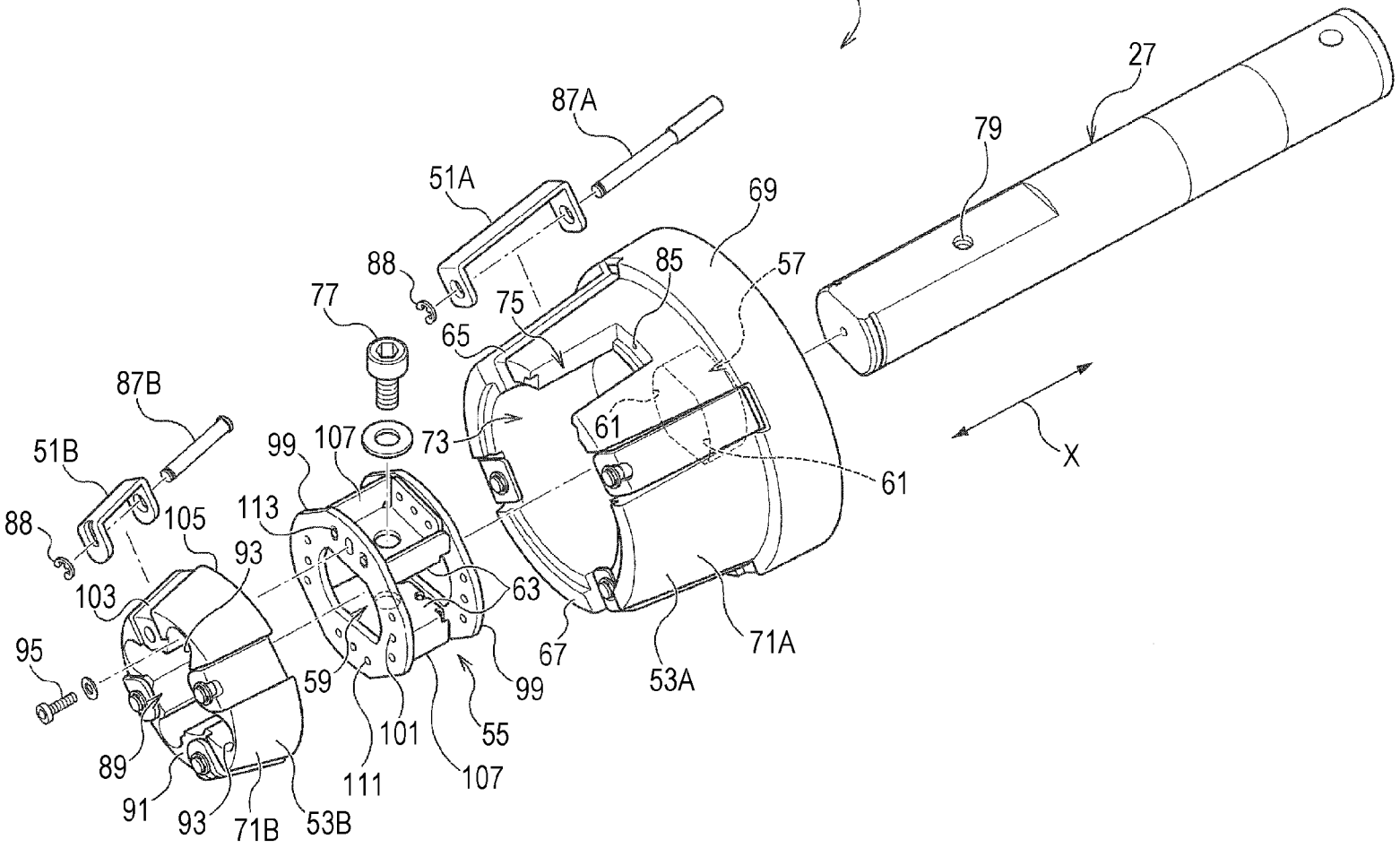
FIG. 8 is an exploded perspective view illustrating the core tube holding device according to the embodiment of the invention.
Figure 10:
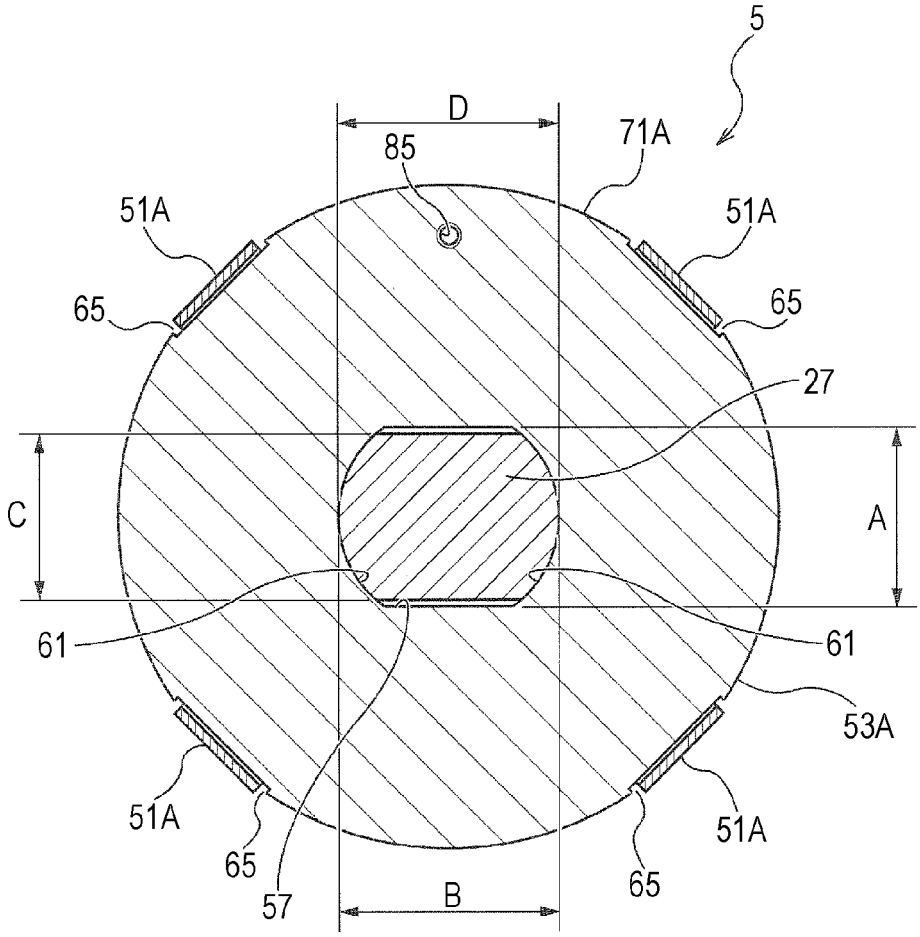
FIG. 10 is a cross-sectional view illustrating the core tube holding device according to the embodiment of the invention taken along line X-X of FIG. 6.

As illustrated in FIGS. 8 and 10, the first opening 57 of the support portion 53 includes a first contact portion 61 which comes into contact with the shaft portion 27 and guides the relative movement of the support portion 53 when the support portion 53 is moved relative to the shaft portion 27 in the axial direction X.

As illustrated in FIGS. 6, 8, 9, and 11, the second opening 59 of the bearing portion 55 includes a second contact portion 63 which is pressed against and comes into contact with the shaft portion 27 when the bearing portion 55 and the shaft portion 27 are fixed to each other.

Figure 11:
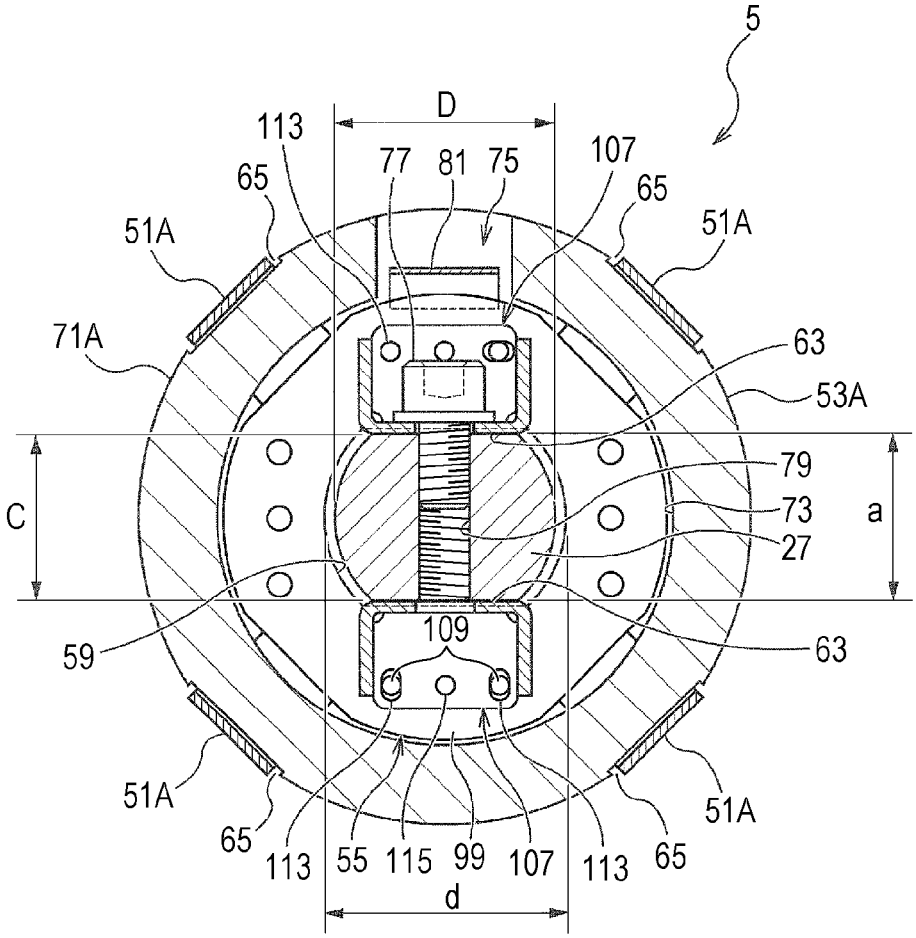
FIG. 11 is a cross-sectional view illustrating the core tube holding device according to the embodiment of the invention taken along line XI-XI of FIG. 6.

In this embodiment, each of the first opening 57 and the second opening 59 is formed to be an elliptical opening as illustrated in FIG. 11 in which two opposing surfaces are formed as arc surfaces having the same radius and the other two opposing surfaces are formed as flat surfaces that are parallel to each other.

In addition, the opposing arc surfaces of the first opening 57 form the first contact portion 61 which comes into contact with the shaft portion 27, and the two opposing flat surfaces of the second opening 59 form the second contact portion 63 which is pressed against and comes into contact with the shaft portion 27.

The cross-sectional shape of the fitting portion of the shaft portion 27 is also an elliptical shape according to the sizes and shapes of the first opening 57 and the second opening 59, and the relationship between the specific dimensions of the first opening 57, the second opening 59, and the shaft portion 27 is described below.

That is, when the dimension of the first opening 57 in the major dimension direction is referred to as B (see FIG. 10), the dimension thereof in the minor dimension direction is referred to as A (see FIG. 10), the dimension of the second opening 59 in the major dimension direction is referred to as b (see FIG. 11), the dimension thereof in the minor dimension direction is referred to as a (see FIG. 11), the dimension of the shaft portion 27 in the major dimension direction is referred to as D (see FIGS. 10 and 11), and the dimension thereof in the minor dimension direction is referred to as C (see FIGS. 10 and 11), the dimensions are set so as to satisfy the relationship of $A>a$, $b>B$, $a>C$ or $a=C$, and $B=D$.

In this embodiment, the holding portion 51 is configured to include a first holding portion 51A which can hold the core tube 3 having a first size (for example, three inches) and a second holding portion 51B which can hold the core tube 3 having a second size (for example, two inches) smaller than the first size.

In this embodiment, the support portion 53 includes a first support portion 53A which supports the first holding portion 51A and a second support portion 53B which supports the second holding portion 51B. The second support portion 53B is disposed on the outside, that is, the tip end side of the first support portion 53A in the axial direction of the held core tube 3.

A first recessed portion 65 for mounting the first holding portion 51A is formed in the first support portion 53A. As illustrated in FIG. 7, the depth T of a recessed portion formed in a joint side end surface 67 joined to the second support portion 53B in the first recessed portion 65 is set to be a depth at which the first holding portion 51A does not protrude from the joint side end surface 67 of the first support portion 53A toward the second support portion 53B side in a state where the first holding portion 51A is supported by the first support portion 53A.

In this embodiment, the second contact portion 63 which is formed in the second opening 59 of the bearing portion 55 is configured so that the distance from the opposing second contact portion 63 can be adjusted.

Figure 9:
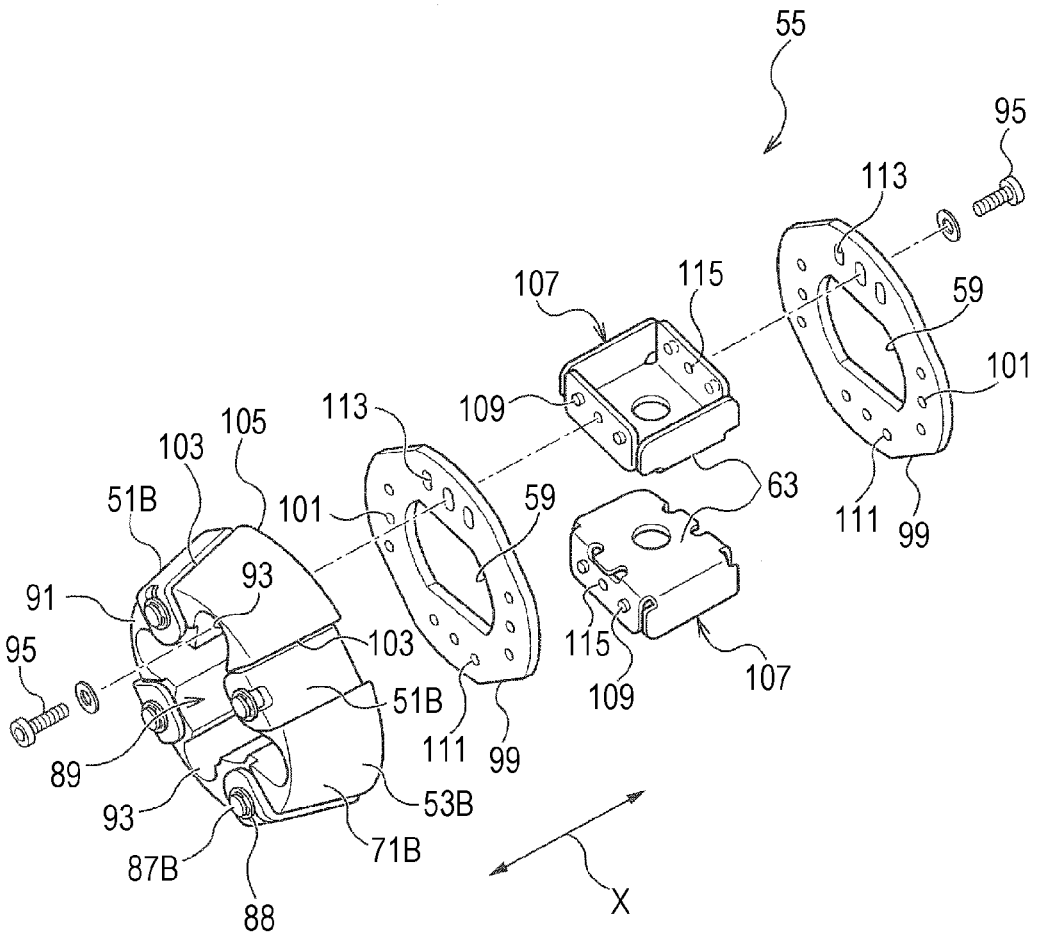
FIG. 9 is an exploded perspective view illustrating a bearing portion of the core tube holding device according to the embodiment of the invention.

Hereinafter, the structure of the core tube holding device 5 according to the embodiment of the invention will be described in detail with reference to exploded perspective views illustrated in FIGS. 8 and 9.

The first support portion 53A is a member made of a synthetic resin, which has an annular flange portion 69 on the base end side thereof and is provided integrally with a support body portion 71A having a truncated cone shape on the inside of the annular flange portion 69. A recessed space 73 which is recessed from the joint side end surface 67 side and has a circular cross-section with a predetermined depth is formed at the center of the support body portion 71A, and the recessed space 73 is an accommodating space of the bearing portion 55, which will be described later.

The first opening 57 which passes through the flange portion 69 and has a predetermined length is formed at the center of the bottom portion of the recessed space 73. In addition, a recessed portion 75 which passes through a portion of the circumferential body portion of the support body portion 71A in the radial direction is formed. The bearing portion 55 and the shaft portion 27 which are assembled to be integrated with the second support portion 53B using the recessed portion 75 are configured to be fixed by inserting and screwing a fixing bolt 77 from the outside into a screw hole 79 recessed in the shaft portion 27.

A cover 81 made by bending a flat plate in a Z-shape as illustrated in FIG. 6 is configured to be mounted in the recessed portion 75, and the cover 81 is mounted on the first support portion 53A by screwing a mounting screw 83 to a screw hole 85 recessed in the bottom surface portion of the recessed portion 75.

The first recessed portion 65 which extends from the base end side to the joint side end surface 67 and reaches the recessed space 73 across the joint side end surface 67 is formed in the outer circumferential surface of the support body portion 71A of the first support portion 53A.

The first recessed portion 65 is provided at each of four positions at equal intervals in the circumferential direction as illustrated in FIG. 5. In each of the four first recessed portions 65, as illustrated in FIG. 7, the plate-shaped first holding portions 51A which are formed in a gate shape along the outer circumferential surface of the support body portion 71A of the first support portion 53A are respectively mounted by using mounting pins 87A and E-rings 88 as a snap ring in a state of having a gap (play) in the radial direction and in the axial direction X.

The second support portion 53B is a member made of a synthetic resin, which is provided with a support body portion 71B having a smaller truncated cone shape than the first support portion 53A.

An elliptical through-hole 89 which passes through the support body portion 71B in the axial direction X is formed at the center of the support body portion 71B, and four screw fixing recessed portions 93 having a predetermined depth which are recessed from a tip end surface 91 side are formed in the circumferential body portion of the support body portion 71B in the vicinity of the through-hole 89 at equal intervals in the circumferential direction.

Hole portions 97 (see FIG. 6) which receive the shaft portions of mounting screws 95 are formed in the bottom plate portions of the four screw fixing recessed portions 93, and the bearing portion 55 is fixed to the base end portion of the second support portion 53B by screwing the shaft portions of the mounting screws 95 inserted from the screw fixing recessed portion 93 side to screw holes 101 recessed in a support disc 99 of the bearing portion 55, which will be described later.

Second recessed portions 103 which have a short action length in the same configuration as the first support portion 53A described above are provided at four positions of the outer circumferential surface of the support body portion 71B of the second support portion 53B at equal intervals in the circumferential direction as illustrated in FIG. 5.

The plate-shaped second holding portions 51B formed in a gate shape along the outer circumferential surface of the support body portion 71B of the second support portion 53B as illustrated in FIG. 7 are respectively mounted in the second recessed portions 103 by using mounting pins 87B having a shorter action length than the first support portion 53A and the E-rings 88 in a state of having a gap (play) from the second recessed portions 103 in the radial direction and in the axial direction X.

As an example, the bearing portion 55 is configured by including the two support discs 99 and 99 which are disposed on the bottom surface side of the recessed space 73 of the first support portion 53A and on a base end surface 105 side of the second support portion 53B, two pressing portions 107 and 107 which are provided to be interposed between the two support discs 99 and 99, and the four mounting screws 95 for assembling the two support discs 99 and 99 and the two pressing portions 107 and 107 to be integrated with each other.

The elliptical second opening 59 described above is formed at the center of the support disc 99, an appropriate number of hole portions 97 that receive the shaft portions of the mounting screws 95 and an appropriate number of screw holes 101 to which the shaft portions of the mounting screws 95 are screwed are provided in the outer circumferential portion of the second opening 59.

Two positioning hole portions 111 and two position adjustment elongated holes 113 which are engaged with protruding portions 109 (see FIG. 9) that protrude outward from the end surfaces of the pressing portions 107, which will be described later, in the axial direction X are provided in the outer circumferential portion of the support disc 99.

The pressing portion 107 is a container-shaped member having an open top portion formed by bending four flat plate portions that extend from the four sides of a rectangular bottom plate portion as the second contact portion 63 to the outside by 90° in the same direction. In addition, the two protruding portions 109 that protrude outward are provided on each of the end surfaces of the pressing portion 107 in the axial direction X as described above, and a single screw hole 115 to which the shaft portion of the mounting screw 95 inserted from the support disc 99 side is screwed is provided at the intermediate position between the two protruding portions 109.

3. Action of Core Tube Holding Device (See FIGS. 1 to 11)

Next, the action of the core tube holding device 5 according to the embodiment of the invention configured as described above will be described according to the modes of "A. during assembly and installation" and "B. during use".

A. During Assembly and Installation (See FIGS. 6 to 11)

In a case of assembling the core tube holding device 5, first, the shaft portion 27 is caused to pass through the first opening 57 of the first support portion 53A. At this time, the shaft portion 27 comes into contact with the first contact portion 61 which is formed as the opposing arc surfaces of the first opening 57, and is inserted while being guided by the first contact portion 61. At this time, the opposing flat surfaces of the first opening 57 do not come into contact with the shaft portion 27.

Subsequently, the shaft portion 27 is caused to pass through the second opening 59 formed in the two support discs 99 and 99 of the bearing portion 55. Before inserting the shaft portion 27, the mounting screws to which the pressing portions 107 having the protruding portions 109 engaged with the position adjustment elongated holes 113 of the support discs 99 and 99 are fixed are loosened in advance so that the pressing portions 107 enter a state of being movable in the radial direction in a range of the length of the elongated hole 113.

At this time, the shaft portion 27 does not come into contact with the opposing arc surfaces of the second opening 59. In addition, among the two flat surfaces of the bottom plate portions of the opposing pressing portions 107 of the second opening 59, the shaft portion 27 comes into contact with the flat surface on the positioning pressing portion 107 side engaged with the positioning hole portion 111, and comes into contact with or does not come into contact with the flat surface on the pressing portion 107 side engaged with the position adjustment elongated hole 113. The two flat surfaces of the bottom plate portions of the opposing pressing portions 107 of the second opening 59 form the second contact portion 63.

Furthermore, the shaft portion 27 is deeply inserted so that the tip end portion of the shaft portion 27 reaches a predetermined position in the tip end surface 91 of the shaft portion 27 through the through-hole 89 formed at the center of the support body portion 71B of the second support portion 53B.

The bottom plate portions of the position adjustment pressing portions 107 come into contact with the shaft portion 27, and in a case where the shaft portion 27 is sufficiently fixed, the position adjustment pressing portions 107 are fixed by fastening the mounting screws 95.

On the other hand, in a case where the bottom plate portions of the position adjustment pressing portions 107 do not come into contact with the shaft portion 27, the position adjustment pressing portions 107 are moved until the bottom plate portions of the position adjustment pressing portions 107 come into contact with the shaft portion 27, and the positions of the pressing portions 107 are fixed by fastening the mounting screws 95.

The assembly and installation of the core tube holding device 5 are generally completed by the above operations. However, in a case where the shaft portion 27 needs to be further sufficiently fixed to use a heavy roll medium R or the like, the cover 81 is removed by loosening the mounting screw 83, the fixing bolt 77 is inserted from the recessed portion 75, and the shaft portion of the fixing bolt 77 is screwed and fastened to the screw hole 79 recessed in the shaft portion 27. When the cover 81 is mounted on the recessed portion 75 again using the mounting screw 83, the assembly and installation of the core tube holding device 5 are completed.

B. During Use (FIGS. 1 to 5)

In a case where the core tube 3 of the roll medium R is set in the core tube holding device 5, the adjustment holder 15 is allowed to be in a state of being movable in the axial direction X by loosening the adjustment screw 23 on the adjustment holder 15 side, and is put aside. Subsequently, the roll medium R for use is mounted on the temporary placing table 19, and the core tube 3 of the roll medium R is positioned on the axis that passes through the center of the core tube holding device 5 on the right and left thereof by operating the operating lever 21.

Subsequently, the adjustment holder 15 which has been put aside is moved to the inside and is moved to a predetermined holding position corresponding to the width dimensions and the size of the core tube 3 of the roll medium R. Thereafter, the loosened adjustment screw 23 is fastened again to fix the position of the adjustment holder 15, and the operating handle 25 is further rotated to increase the clamping force of the core tube 3.

The inner circumferential portions of both the right and left ends of the core tube 3 come into contact with the inclined guiding surface of the first holding portion 51A or the second holding portion 51B, and are inserted to reach predetermined insertion positions while being guided by the guiding surfaces. In the first holding portion 51A and the second holding portion 51B, since the gap (play) in the radial direction and in the axial direction X is formed between the first recessed portion 65 and the second recessed portion 103, slight variations in the core tube 3 are absorbed by the gap (play), thereby performing smooth setting of the roll medium R.

Subsequently, the start end portion of the recording medium P is drawn from the roll medium R set in the unwinding core tube holding unit 11F, is guided to the transport path 31 of the medium transporting device 7 to reach the winding position of the winding core tube holding unit 11R, and is wound around the separate core tube 3 which is set in advance so as to enter a printable state, and recording is started by outputting a recording execution command.

Accordingly, when the motor 29 is started and the shaft portion 27 is rotated, the core tube holding device 5 on the reference holder 17 side is driven to rotate, and the rotation is transmitted to the core tube holding device 5 on the adjustment holder 15 side via the core tube 3 so as to be rotated.

Accordingly, a necessary amount of the recording medium P is sequentially unwound from the roll medium R set in the unwinding core tube holding unit 11F, recording is performed thereon by the recording execution device 9 in the recording execution area S, and the recorded matter is wound around the core tube 3 set in the winding core tube holding unit 11R.

At this time, forces are applied between the core tube 3 and the first holding portion 51A or the second holding portion 51B and between the shaft portion 27 and the bearing portion 55. However, in this embodiment, since the first holding portion 51A, the second holding portion 51B, the bearing portion 55, and the shaft portion 27 are formed of a hard metal material, wear and damage of the first holding portion 51A, the second holding portion 51B, and the bearing portion 55 are suppressed, and thus the transport accuracy of the recording apparatus 1 is increased. Therefore, a further stable improvement in recording execution quality can be achieved.

Other Embodiments

The core tube holding device 5 and the recording apparatus 1 according to the invention basically have the above-described configuration. However, partial changes and omissions of the configuration can be made without departing from the scope of the invention.

For example, in a case where the size of the roll medium R for use is determined in advance, a single holding portion 51 and a single support portion 53 may be used. The number of holding portions 51 arranged in the circumferential direction at equal intervals is not limited to four, and may be three or another number. The holding portion 51, the support portion 53, and the bearing portion 55 may be integrally formed.

The shapes and sizes of the first opening 57 and the second opening 59 can be changed in various manners depending on the shape and size of the shaft portion 27, and imparting hardness to the holding portion 51, the bearing portion 55, and the shaft portion 27 is also not limited to the above-described embodiment.

For example, even in a case where a synthetic resin containing carbon fiber is used instead of a metal material or the holding portion 51, the support portion 53, and the bearing portion 55 are integrally formed, only a portion which needs hardness may be coated with a hard material, or may be hardened by heat treatment such as quenching.

In this embodiment, a total of four core tube holding devices 5 having the above-described configuration are arranged in both the unwinding core tube holding unit 11F and the winding core tube holding unit 11R. However, the core tube holding device 5 may also be disposed at at least one position among the four positions. Particularly, the core tube holding device 5 may be disposed at a position connected to the shaft portion connected to the motor 29.

In this embodiment, the invention is applied to the recording apparatus 1 which discharges ink, but the invention may be also applied to a liquid discharge apparatus which discharges (or ejects) a liquid (droplets) other than ink. For example, the invention may be applied to a liquid discharge apparatus which discharges a liquid (functional fluid) containing a material such as an electrode material or a color material which is used for manufacturing a liquid crystal display, an organic EL (electroluminescence) display, a field emission display, a color filter, and the like, in a dispersed or dissolved form.

The invention may be used for a liquid discharge apparatus which discharges a biological organic material used for manufacturing biochips, a liquid discharge apparatus which discharges a liquid that is used as a precision pipette and becomes a specimen, a printing apparatus, a micro-dispenser, and the like.

The invention may be used for a liquid discharge apparatus which discharges lubricating oil to precision machinery such as watches or cameras with pinpoint precision, a liquid discharge apparatus which discharges a transparent resin liquid such as an ultraviolet curable resin to a substrate to form a micro-hemispherical lens (optical lens) or the like used for optical communication elements and the like, and a liquid discharge apparatus which discharges an acidic or alkaline etchant for etching a substrate and the like.

As a mode of discharging a liquid, a mode of discharging a liquid to allow the liquid to fly in a granular state, a mode of discharging a liquid to allow the liquid to fly in a tear-like state, a mode of discharging a liquid to allow the liquid to fly in a thread-like state with trails, and the like may be considered.

The liquid may be a liquid material which can be discharged from the liquid discharge apparatuses. For example, liquid-phase materials with high or low viscosities, sol, gel water, and fluid-phase materials such as inorganic solvents, organic solvents, solutions, liquid-phase resin, and liquid-phase metals (metallic melts), a material in which particles of functional materials made of solids such as pigments or metallic particles are dissolved, dispersed, or mixed with the solvent, and the like in addition to a liquid as a state of a material may be considered.

The entire disclosure of Japanese Patent Application No. 2013-203484, filed Sep. 30, 2013 is expressly incorporated by reference herein.

What is claimed is:

1. A core tube holding device comprising:

a support portion which is able to support a core tube;

a shaft portion which rotates the support portion;

a holding portion which holds the core tube, wherein the support portion is able to support the core tube via the holding portion, and wherein the holding portion is mounted on the support portion in a state of having a play in a radial direction and an axial direction relative to the shaft portion; and a bearing portion which is connected to the support portion and into which the shaft portion is inserted, wherein the bearing portion is harder than the support portion.

2. The core tube holding device according to claim 1, wherein the shaft portion is harder than the support portion.

3. A recording apparatus comprising:

a recording execution device which executes recording on a recording medium; and a core tube holding device which holds a cylindrical core tube that is able to hold the recording medium in a roll shape, wherein the core tube holding device is the core tube holding device according to claim 2.

4. The core tube holding device according to claim 1, wherein hardnesses of the shaft portion and the bearing portion are the same.

5. A recording apparatus comprising:

a recording execution device which executes recording on a recording medium; and a core tube holding device which holds a cylindrical core tube that is able to hold the recording medium in a roll shape, wherein the core tube holding device is the core tube holding device according to claim 4.

6. The core tube holding device according to claim 1, wherein the support portion includes a first opening into which the shaft portion is inserted, the bearing portion includes a second opening into which the shaft portion is inserted, and the first opening and the second opening are different in at least one of size and shape.

7. A recording apparatus comprising:

a recording execution device which executes recording on a recording medium; and a core tube holding device which holds a cylindrical core tube that is able to hold the recording medium in a roll shape, wherein the core tube holding device is the core tube holding device according to claim 6.

8. The core tube holding device according to claim 6, wherein the first opening of the support portion includes a first contact portion which comes into contact with the shaft portion and guides relative movement of the support portion when the support portion is moved relative to the shaft portion in an axial direction, and the second opening of the bearing portion includes a second contact portion which is pressed against and comes into contact with the shaft portion when the bearing portion and the shaft portion are fixed to each other.

9. The core tube holding device according to claim 8, wherein the first opening and the second opening are elliptical openings in which two opposing surfaces are formed as arc surfaces having the same radius and the other two opposing surfaces are formed as flat surfaces that are parallel to each other, the opposing arc surfaces of the first opening form the first contact portion which comes into contact with the shaft portion, and the two opposing flat surfaces of the second opening form the second contact portion which is pressed against and comes into contact with the shaft portion.

10. A recording apparatus comprising:

a recording execution device which executes recording on a recording medium; and a core tube holding device which holds a cylindrical core tube that is able to hold the recording medium in a roll shape, wherein the core tube holding device is the core tube holding device according to claim 9.

11. A recording apparatus comprising:

a recording execution device which executes recording on a recording medium; and a core tube holding device which holds a cylindrical core tube that is able to hold the recording medium in a roll shape, wherein the core tube holding device is the core tube holding device according to claim 8.

12. The core tube holding device according to claim 8, wherein a distance between the second contact portion which is formed in the second opening of the bearing portion and an additional second contact portion of the bearing portion is adjustable, and the second contact portion and the additional second contact portion are disposed opposite each other.

13. The core tube holding device according to claim 1, wherein the holding portion includes a first holding portion which is able to hold the core tube having a first size and a second holding portion which is able to hold the core tube having a second size smaller than the first size.

14. The core tube holding device according to claim 13, wherein the support portion includes a first support portion which supports the first holding portion and a second support portion which supports the second holding portion, and the second support portion is disposed on an outside of the first support portion in an axial direction of the held core tube.

15. The core tube holding device according to claim 14, wherein the first support portion includes a first recessed portion for mounting the first holding portion, and a depth of a recessed portion which is formed in a joint side end surface joined to the second support portion in the first recessed portion is set to be a depth at which the first holding portion does not protrude from the joint side end surface of the first support portion toward the second support portion side in a state where the first holding portion is supported by the first support portion.

16. A recording apparatus comprising:

a recording execution device which executes recording on a recording medium; and a core tube holding device which holds a cylindrical core tube that is able to hold the recording medium in a roll shape, wherein the core tube holding device is the core tube holding device according to claim 14.

17. A recording apparatus comprising:

a recording execution device which executes recording on a recording medium; and a core tube holding device which holds a cylindrical core tube that is able to hold the recording medium in a roll shape, wherein the core tube holding device is the core tube holding device according to claim 13.

18. A recording apparatus comprising:

a recording execution device which executes recording on a recording medium; and a core tube holding device which holds a cylindrical core tube that is able to hold the recording medium in a roll shape, wherein the core tube holding device is the core tube holding device according to claim 1.

* * * * *